US005576806A

United States Patent [19]

Oka et al.

[11] Patent Number: 5,576,806

[45] Date of Patent: Nov. 19, 1996

[54] CHARGING ROLL FOR ELECTROPHOTOGRAPHY

[75] Inventors: Kozo Oka; Kazuhiko Yanagida; Taketoshi Hoshizaki; Kazuhiro Koseki, all of Minami-ashigara, Japan

[73] Assignee: Fuji Xerox Co., Ltd., Tokyo, Japan

[21] Appl. No.: 517,207

[22] Filed: Aug. 21, 1995

[30] Foreign Application Priority Data

Aug. 24, 1994 [JP] Japan ..... 6-220851

[51] Int. Cl.$^6$ ..... G03G 15/02

[52] U.S. Cl. ..... 355/219; 361/225; 430/902

[58] Field of Search ..... 355/200, 210, 355/219; 361/225; 430/31, 32, 34, 35, 902

[56] References Cited

U.S. PATENT DOCUMENTS

| | | | |
|---|---|---|---|
| 5,089,851 | 2/1992 | Tanaka et al. | 355/219 |
| 5,148,219 | 9/1992 | Kohyama | 355/219 |
| 5,384,626 | 1/1995 | Kugoh et al. | 355/219 |
| 5,463,450 | 10/1995 | Inoue et al. | 355/219 |
| 5,471,285 | 11/1995 | Nagase et al. | 355/219 |

FOREIGN PATENT DOCUMENTS

| | | | |
|---|---|---|---|
| 64-66675 | 3/1989 | Japan . | |
| 4-86765 | 3/1992 | Japan | 355/219 |
| 4-106565 | 4/1992 | Japan | 355/219 |
| 6-186824 | 7/1994 | Japan | 355/219 |
| 6-186825 | 7/1994 | Japan | 355/219 |

*Primary Examiner*—Sandra L. Brase
*Attorney, Agent, or Firm*—Oliff & Berridge

[57] ABSTRACT

A charging roll fit for use at high speed, having good maintaining property of charging characteristics in long-term use, stable in electric resistance under the environmental conditions, and having no fear of pinhole leak and photoreceptor contamination, which comprises a conductive shaft and a conductive layer formed thereon, wherein said conductive layer contains a layer in which $SnO_{2-x}$-coated $BaSO_4$ particles having an electric resistance of 0.1 to 10 Ω·cm are dispersed in a resin, and the value of x is 0 to 1.

17 Claims, No Drawings

CHARGING ROLL FOR ELECTROPHOTOGRAPHY

FIELD OF THE INVENTION

The present invention relates to charging rolls of electrophotographic copying machines.

BACKGROUND OF THE INVENTION

A conductive roll used as a charging roll of an electrophotographic copying machine has been required to have conductivity within the electric resistance range from about $10^3$ Ω to about $10^9$ Ω (measured using an electrode having an area of 1 $cm^2$), and usually comprises a metal shaft and a conductive layer formed on a peripheral surface thereof.

In order to fully function as the charging roll, it has been considered that such a conductive roll is desirable to have an electric resistance level ranging from about $10^3$ Ω to about $10^9$ Ω as described above. The charging roll is pressed on a peripheral surface of a photosensitive drum for rotation to charge the peripheral surface of the photosensitive drum by sliding friction of the contact portion. The charging roll is therefore required to have elasticity. Accordingly, the above-described conductive layer of the charging roll is generally formed of a conductive rubber composition in which a conductive powder (carbon black, a metal powder or the like) or conductive fibers (carbon fibers or the like) are incorporated in synthetic rubber such as silicone rubber. Further, a charging roll has also been known which is provided with an ionic conductive elastic layer utilizing the inherent ionic conductivity of the synthetic rubber or enhanced in the ionic conductivity of the above-described synthetic rubber by addition of a high dielectric liquid or an ionic substance thereto. However, repetition of charging using the charging roll having these conductive rubber layers, with the conductive rubber layer being in direct contact with the surface of the photoreceptor, introduces the problem that low molecular weight components contained in the conductive rubber layer are transferred to the photoreceptor to cause image defects. Further, the rubber is worn away by contact with the photoreceptor to largely change the unevenness of the surface of the roll from the initial state, thereby impairing the uniformity of charging. Furthermore, high conductivity of the conductive rubber layer produces so-called pinhole leak, the phenomenon that excess current flows in defective portions of the photoreceptor, resulting in appearance of image defects.

In order to solve such problems, the surface of the conductive rubber layer is provided with resins low in electric resistance as protective layers. In this case, however, there is the problem that the electric resistance varies depending on the environmental conditions, resulting in changes in image density. For this reason, attempts have been made to add a conductive material such as carbon black to the surface resin layer (hereinafter sometimes referred to outermost layer). It is however impossible to prevent the dielectric breakdown of the photoreceptor or the charging roll in case of certain kinds of defects. It has been therefore tried to add conductive particles having an electric resistance of $10^1$ to $10^5$ Ω·cm to the resins [JP-A-64-66675 (the term "JP-A" as used herein means an "unexamined published Japanese patent application")]. In this case, however, charging ability is insufficient in high speed charging in which the process speed of charging exceeds 100 mm/second, and particularly, it is difficult to maintain stable charging characteristics in long-term use.

As described above, all of the conventional charging rolls suffer from the problems of photoreceptor contamination, pinhole leak, changes in electric resistance depending on the environmental conditions, poor charging in high speed charging and deterioration of maintaining property of charging characteristics in long-term use, and therefore, no satisfactory roll has been obtained.

SUMMARY OF THE INVENTION

It is therefore an object of the present invention to provide a charging roll excellent in quality, namely a charging roll fit for use at high speed, having good maintaining property of charging characteristics in long-term use, stable in electric resistance under the environmental conditions, and having no fear of pinhole leak and photoreceptor contamination.

As a result of studies to attain the above-described object, the present inventors have discovered that the above-described object is attained by using a roll of which a surface or an inside is formed of a resin layer containing $BASO_4$ particles coated with $SnO_{2-x}$ ($0 \leqq x \leqq 1$) (hereinafter sometimes referred to $SnO_{2-x}$-coated $BASO_4$ particles), the $SnO_{2-x}$-coated $BaSO_4$ particles having an electric resistance of 10 Ω·cm or less, thus completing the present invention.

According to the present invention, there is provided a charging roll for electrophotography comprising a conductive shaft and a conductive layer formed thereon, wherein said conductive layer contains a layer in which $SnO_{2-x}$ coated $BaSO_4$ particles having an electric resistance of 0.1 to 10 Ω·cm are dispersed in a resin.

DETAILED DESCRIPTION OF THE INVENTION

The present invention will be described in detail below.

In the charging roll of the present invention, the conductive layer formed on the conductive shaft may have a laminated structure comprising a conductive elastic layer and a surface resin layer. When the charging roll is used for the purpose of charging a photoreceptor having a strong surface such as amorphous silicone, the above-described surface resin layer may be directly formed on a peripheral surface of the conductive shaft without formation of the conductive elastic layer as described above. In order to improve adhesiveness and dielectric strength, an intermediate layer may be further provided between the conductive elastic layer and the surface resin layer.

In these cases, the $SnO_{2-x}$-coated $BASO_4$ particles having an electric resistance of 0.1 to 10 Ω·cm is required to at least exist in the surface resin layer as a surface forming layer. When the intermediate layer is provided, however, the $SnO_{2-x}$-coated $BASO_4$ particles may be allowed to further exist in the intermediate layer.

The charging roll of the present invention can be produced, for example, in the following manner. First, an elastic material such as synthetic rubber, in which a conductive material such as conductive carbon has been compounded, is wrapped around a metal shaft treated with an adhesive, and cured in a mold, followed by grinding to form a conductive elastic layer. Then, a solvent-soluble resin excellent in durability such as a nylon copolymer is dissolved in an appropriate solvent, and the $SnO_{2-x}$-coated $BASO_4$ particles having an electric resistance of 0.1 to 10 Ω·cm are dispersed in the resulting solution to prepare a coating solution. This solution is applied to a peripheral surface of the above-described conductive elastic layer and dried, whereby the charging roll of the present invention can be obtained.

The conductive shaft preferably used in the present invention includes shafts of metals such as aluminum alloys, stainless steal and brass.

The conductive elastic material suitably used for the conductive elastic layer includes rubber materials such as silicone rubber, urethane rubber, fluorocarbon rubber and EPDM rubber in which a conductive material such as carbon black, metal oxides and lithium perchlorate is dispersed. The film thickness of the conductive elastic layer is preferably set up within the range from 0.1 to 10 mm.

The material used for the intermediate layer can be selected from resins and rubber materials. Such materials include resins such as polyesters, phenol resins, acrylic resins, polyurethanes, epoxy resins, cellulose resins, polyvinyl alcohol and prulan, epichlorohydrin-ethylene oxide copolymer rubber, silicone rubber, urethane rubber and EPDM rubber.

Further, the materials suitably used for the surface resin layers include polyamides, polyesters, phenol resins, acrylic resins, polyurethanes, epoxy resins, silicone resins and fluorocarbon resins. Among them, polyamides are preferred in terms of charge latitude.

Furthermore, the $SnO_{2-x}$-coated $BaSO_4$ particles used in the present invention have an electric resistance of 0.1 to 10 Ω·cm, preferably 3 to 8 Ω·cm. An electric resistance of higher than 10.0 Ω·cm results in a decrease in charging performance at high speed and an increase in charging unevenness, whereas an electric resistance of lower than 0.1 Ω·cm results in easy generation of pinhole leak and failure in exerting the effects of the present invention. The electric resistance of the $SnO_{2-x}$-coated $BaSO_4$ particles can be adjusted by changing the value of x of $SnO_{2-x}$ ($0 \leqq x \leqq 1$) and the content thereof. Further, in order to give conductivity, $SnO_{2-x}$ ($0 \leqq x \leqq 1$) may contain an element such as antimony or fluorine, preferably in an amount of about 5 to 20 wt %.

In addition, the particle size of the $SnO_{2-x}$-coated $BaSO_4$ particles used is generally within the range from 0.01 to 5 μm. The surface coating of the $SnO_{2-x}$-coated $BaSO_4$ particles can be carried out, for example, by a method comprising suspending the $BaSO_4$ particles in an aqueous solution of $SnCl_4$ to react with each other, and then burning the reaction product. The content of $SnO_{2-x}$ ($0 \leqq x \leqq 1$) contained in the $SnO_{2-x}$-coated $BaSO_4$ particles is preferably within the range from 5% by weight to 90% by weight, and more preferably within the range from 60% by weight to 90% by weight.

In the present invention, an electric resistance of the $SnO_{2-x}$-coated $BASO_4$ particles is measured as follows. Each sample of the $SnO_{2-x}$-coated $BaSO_4$ particles is filled in a cap made by aluminum, then press molded the sample with a press and measured the electric resistance of the molded sample with a four-probe method of the resistivity measurement using an electric resistance meter (Loresta AP, made by Mitsubishi Petrochemical Co., Ltd.).

In the present invention, the content of the $SnO_{2-x}$-coated $BaSO_4$ particles contained in the surface resin layer or the intermediate resin layer is preferably within the range from 30% by weight to 80% by weight based on the resin, and more preferably within the range from 40% by weight to 70% by weight. If the content of the $SnO_{2-x}$-coated $BASO_4$ particles is too small, sufficient charging potential of the photoreceptor cannot be obtained. On the other hand, if the content is too large, the dielectric breakdown of the surface resin layer or the intermediate resin layer is liable to take place and the strength of the film decreases.

The value of x is 0 to 1, preferably more than 0 and not more than 0.1.

The film thickness of each of the surface resin layer and the intermediate resin layer in the present invention is desirably 5 μm to 20 μm.

Further, it is also possible to add a fluorine series resin or particles to the above-described conductive layer to make the surface thereof hydrophobic, thereby preventing contaminants from adhering to the surface of the charging roll. Furthermore, it is also possible to add insulating particles such as alumina or silica to give unevenness to the surface of the charging roll, thereby reducing the load in sliding with the photoreceptor to improve the mutual wear resistance of the charging roll and the photoreceptor.

In the present invention, resistance control is conducted by the $BaSO_4$ particles coated with $SnO_{2-x}$ ($0 \leqq x \leqq 1$), whereby the electric resistance of the conductive layer does not change depending on the environmental conditions to obtain stable characteristics. In general, a resin film formed by dispersing another metal oxide or carbon black therein has a high electric field dependence of electric resistance, and application of a high voltage to the charging roll results in a rapid reduction in electric resistance to cause the dielectric breakdown of the resin film. However, the conductive layer used in the present invention is characterized by a low electric field dependence of electric resistance, resulting in difficulty of pinhole leak generation. Further, an electric resistance of the $SnO_{2-x}$-coated $BASO_4$ particles within the range from 0.1 Ω·cm to 10.0 Ω·cm causes high speed response of charging, namely makes it possible to charge the receptor to a sufficient potential in use at high speed, and results in the stability of charging characteristics in long-term use.

The reason why the charging roll of the present invention has high speed response of charging and the stability of charging characteristics in long-term use, and further has the property that it is difficult to generate pinhole leak is not clear. However, the reason for this is presumed to be that the $SnO_{2-x}$-coated $BASO_4$ particles used in the present invention have a low dependence of electric resistance and a suitable electric resistance of the charging roll necessary for compatibility of charging and pinhole leak resistance is kept stable under various conditions in use.

The present invention will hereinafter be illustrated with reference to Examples, together with Comparative Examples.

EXAMPLE 1

Three hundred and fifty parts by weight of methanol was added as a solvent to 45 parts by weight of a nylon copolymer (CM 8000, manufactured by Toray Industries, Inc.) and 55 parts by weight of fine conductive particles having an electric resistance of 4 Ω·cm (Passtran TYPE-IV, manufactured by Mitsui Mining & Smelting Co., Ltd.) in which fine $BASO_4$ particles were coated with tin oxide, and the mixture was dispersed in a sand grinder mill for about one hour to prepare a coating solution for a surface resin layer. After adjustment of viscosity, the resulting coating solution was poured into a dip coating tank. On the other hand, a metal shaft made of stainless steel having a diameter of 8 mm was prepared, and an EPDM rubber composition (having a hardness of 50 degrees and an electric resistance of $10^4$ Ω) in which conductive carbon was compounded was wrapped around the shaft. The shaft around which the rubber composition was wrapped was placed in a mold, and treated at 160° C. for 20 minutes, followed by grinding with a grinder to form a conductive elastic layer having a thickness of 3 mm. The metal shaft with the conductive elastic layer thus obtained was dipped in the coating solution previously prepared which was contained in the dip coating tank to coat the conductive elastic layer with the coating solution. The solvent was removed by drying at 150° C. for 10 minutes to form a surface resin layer having a thickness of 20 μm. Thus, a desired charging roll was obtained.

EXAMPLE 2

A charging roll was obtained in the same manner as with Example 1 with the exception that a polyester resin (VYLON 290, manufactured by Toyobo Co., Ltd.) was substituted for the nylon copolymer.

EXAMPLE 3

Two hundred and seventy parts by weight of cyclohexanone was added as a solvent to 20 parts by weight of cyanoethylated prulan (Cyano resin CR-S, manufactured by Shin-Etsu Chemical Co., Ltd.), 20 parts by weight of cyanoethylated polyvinyl alcohol (Cyano resin CR-V, manufactured by Shin-Etsu Chemical Co., Ltd.) and 60 parts by weight of fine conductive particles having an electric resistance of 6 Ω·cm (Passtran TYPE-IV, manufactured by Mitsui Mining & Smelting Co., Ltd.) in which fine $BASO_4$ particles were coated with tin oxide, and the mixture was dispersed in a sand grinder mill for about one hour to obtain a coating solution for an intermediate resin layer. After adjustment of viscosity, the resulting coating solution was poured into a dip coating tank. The metal shaft with the conductive elastic layer described in Example 1 was dipped in the coating solution previously prepared which was contained in the dip coating tank to coat the conductive elastic layer with the coating solution. The solvent was removed by drying at 150° C. for 10 minutes to form a first layer (intermediate resin layer). The thickness of this resin layer was 40 μm. The coating solution of Example 1 was further applied thereon in the same manner as with Example 1 to form a second layer (surface resin layer). The thickness of this layer was 20 μm. Thus, a desired charging roll was obtained.

EXAMPLE 4

A charging roll was obtained in the same manner as with Example 3 with the exception that a polyester resin (VYLON 300, manufactured by Toyobo Co., Ltd.) was used as a resin forming the first layer (intermediate resin layer).

EXAMPLE 5

A charging roll was obtained in the same manner as with Example 1 with the exception that spray coating was used in place of the dip coating of Example 1. In this case, the thickness of the surface resin layer was 40 μm.

COMPARATIVE EXAMPLE 1

A charging roll was obtained in the same manner as with Example 1 with the exception that carbon black (Ketjen Black, manufactured by AKZO) was substituted for Passtran.

COMPARATIVE EXAMPLE 2

A charging roll was obtained in the same manner as with Example 3 with the exception that conductive zinc oxide particles were substituted for Passtran.

COMPARATIVE EXAMPLE 3

A charging roll was obtained in the same manner as with Example 1 with the exception that Passtran having an electric resistance of $10^2$ Ω·cm was used.

Each of these rolls was mounted on a printer of an electrophotographic system, and an AC voltage on which a DC component was superimposed was applied to the charging roll while rotating an organic photoreceptor drum and the charging roll in contact with each other, thereby charging the photoreceptor drum to repeatedly produce images. The charging process speed of the photoreceptor drum and the charging roll was 200 mm/second. This test was intermittently conducted under the circumstances of high temperature and humidity, and low temperature and humidity. As a result, the charging rolls in Examples 1 to 5 gave good images even when 20,000 sheets were printed.

In contrast, the charging rolls in Comparative Examples 1 to 3 provided spot-like defects in images at the time when about 1,000 sheets were printed under circumstances of low temperature and humidity, and these defects changed to linear defects. The cause of these defects is presumed to be so-called pinhole leak due to the dielectric breakdown of the photoreceptor. When 10,000 or more sheets were further printed, images low in contrast caused by poor charging were obtained. The cause of this is presumed to be a gradual increase in electric resistance of the surface resin layers. Further, when the charging roll of Comparative Example 3 was used, normal images were obtained under circumstances of high temperature and humidity, but images low in contrast caused by poor charging were obtained under circumstances of high temperature and humidity. The cause of this is presumed to be a change in electric resistance of the surface resin layer according to the environmental conditions.

As described above, the charging rolls of the present invention have the following excellent effects:

(1) It is difficult to generate pinhole leak;

(2) Excellent in high speed response of charging, namely it is possible to charge the photoreceptor to a sufficient potential in use at high speed;

(3) The electric resistance is stable in repeated use and under the environmental conditions; and (4) Photoreceptor contamination does not take place.

While the invention has been described in detail and with reference to specific embodiments thereof, it will be apparent to one skilled in the art that various changes and modifications can be made therein without departing from the spirit and scope thereof.

What is claimed is:

1. A charging roll for electrophotography, which comprises a conductive shaft having formed thereon a conductive layer, wherein said conductive layer comprises a layer in which $SnO_{2-x}$-coated $BASO_4$ particles are dispersed in a resin, said $SnO_{2-x}$-coated $BASO_4$ particles having an electric resistance of 0.1 to 10 Ω·cm, and the value of x being 0 to 1.

2. The charging roll according to claim 1, wherein said layer in which said $SnO_{2-x}$-coated $BaSO_4$ particles are dispersed in the resin is an outermost layer of the charging roll.

3. A charging roll for electrophotography, which comprises a conductive shaft having formed thereon an outermost layer in which $SnO_{2-x}$-coated $BASO_4$ particles are dispersed in a resin, said $SnO_{2-x}$-coated $BaSO_4$ particles having an electric resistance of 0.1 to 10 Ω·cm, and the value of x being 0 to 1.

4. The charging roll for electrophotography according to claim 3, which further comprises a conductive elastic layer between said conductive shaft and said outermost layer.

5. The charging roll for electrophotography according to claim 4, which further comprises an intermediate layer between said conductive elastic layer and said outermost layer.

6. The charging roll for electrophotography according to claim 5, wherein said intermediate layer comprises at least one of a resin or a rubber material selected from the group consisting of polyester, phenol resin, acrylic resin, polyurethane, epoxy resin, cellulose resin, polyvinyl alcohol, prulan, epichlorohydrin-ethylene oxide copolymer rubber, silicone rubber, urethane rubber and EPDM rubber.

7. The charging roll for electrophotography according to claim 5, wherein said intermediate layer comprises at least one of cyanoethylated prulan and cyanoethylated polyvinyl alcohol.

8. The charging roll for electrophotography according to claim 5, wherein said intermediate layer has a thickness of from 5 to 200 μm.

9. The charging roll for electrophotography according to claim 3, wherein said $SnO_{2-x}$ coated $BASO_4$ particles have an electric resistance of 3 to 8 Ω·cm.

10. The charging roll for electrophotography according to claim 3, wherein said resin is at least one selected from the group consisting of polyamide, polyester, phenol resin, acrylic resin, polyurethane, epoxy resin, silicone resin and fluorocarbon resin.

11. The charging roll for electrophotography according to claim 3, wherein said resin is nylon copolymer or polyester resin.

12. The charging roll for electrophotography according to claim 3, wherein said resin is polyamide.

13. The charging roll for electrophotography according to claim 3, wherein said outermost layer has a thickness of from 5 to 200 μm.

14. The charging roll for electrophotography according to claim 3, wherein said $SnO_{2-x}$ coated $BaSO_4$ particles has a $SnO_{2-x}$ content of from 5 to 90 wt %.

15. The charging roll for electrophotography according to claim 3, wherein said $SnO_{2-x}$ coated $BASO_4$ particles has a $SnO_{2-x}$ content of from 60 to 90 wt %.

16. The charging roll for electrophotography according to claim 3, wherein the content of said $SnO_{2-x}$ coated $BASO_4$ particles is from 30 to 80 wt % based on said resin.

17. The charging roll for electrophotography according to claim 3, wherein the content of said $SnO_{2-x}$ coated $BaSO_4$ particles is from 40 to 70 wt % based on said resin.

* * * * *